US010207520B2

(12) United States Patent
Nakamoto et al.

(10) Patent No.: US 10,207,520 B2
(45) Date of Patent: Feb. 19, 2019

(54) MULTI-COLOR PRINTING METHOD ON PLASTIC FILM AND MULTI-COLOR PRINTING APPARATUS

(71) Applicant: NAKAMOTO PACKS CO., LTD., Osaka (JP)

(72) Inventors: Shunichiro Nakamoto, Osaka (JP); Masaru Masutani, Osaka (JP)

(73) Assignee: NAKAMOTO PACKS CO., LTD., Osaka-Shi (JP)

( * ) Notice: Subject to any disclaimer, the term of this patent is extended or adjusted under 35 U.S.C. 154(b) by 0 days.

(21) Appl. No.: 15/796,143

(22) Filed: Oct. 27, 2017

(65) Prior Publication Data

US 2018/0370254 A1 Dec. 27, 2018

(30) Foreign Application Priority Data

Jun. 27, 2017 (JP) ..... 2017-124902

(51) Int. Cl.
*B41J 11/00* (2006.01)
*B41J 2/21* (2006.01)

(52) U.S. Cl.
CPC ..... *B41J 11/0015* (2013.01); *B41J 2/21* (2013.01)

(58) Field of Classification Search
CPC ..... B41J 11/0015; B41J 2/21; B41J 11/002; B41J 11/057; B41M 1/10; B41M 1/14;
(Continued)

(56) References Cited

U.S. PATENT DOCUMENTS 3,920,875 A 11/1975 Suzuki et al.
9,376,582 B1 * 6/2016 Dannhauser ..... B41M 5/0047
(Continued)

FOREIGN PATENT DOCUMENTS

JP 2010-229310 A 10/2010
JP 2012-111822 A 6/2012
(Continued)

OTHER PUBLICATIONS

Extended European Search Report dated Mar. 28, 2018 for European Application No. 17189919.8.

*Primary Examiner* — Henok Legesse
(74) *Attorney, Agent, or Firm* — Birch, Stewart, Kolasch & Birch, LLP

(57) ABSTRACT

The invention was made in order to provide a multi-color printing method of a plastic film wherein multi-color print can be made fast without requiring complex operations, while functions of the anchor-coating layer and the shielding are ensured sufficiently, and provides a method of multi-color printing on a plastic film, which comprises an anchor-coating process wherein an anchoring agent is applied to the plastic film by a gravure roll to form an anchor-coating layer which acts as receptive layer to multi-color inks, a multi-color printing process wherein multi-color print is provided on said anchor-coating layer by continuous ink jet printers, a shielding layer-coating process wherein a titanium white ink is applied to said multi-color print by a gravure roll to form a shielding layer, and drying processes being provided after said anchor-coating process, multi-color printing process and shielding layer-coating process, respectively, and an apparatus therefor.

8 Claims, 4 Drawing Sheets

(58) Field of Classification Search
CPC ..... B41M 1/26; B41M 1/30; B41M 5/50; B41M 5/0041; B41M 5/0047; B41M 5/0064
See application file for complete search history.

(56) References Cited

U.S. PATENT DOCUMENTS

| | | | | |
|---|---|---|---|---|
| 2013/0108794 | A1* | 5/2013 | Nakamoto ..... | B41F 23/042 427/374.1 |
| 2014/0070464 | A1 | 3/2014 | Lin et al. | |

FOREIGN PATENT DOCUMENTS

| | | | |
|---|---|---|---|
| JP | 2012-233148 | A | 11/2012 |
| JP | 2013-10816 | A | 1/2013 |

* cited by examiner

[Fig. 1]
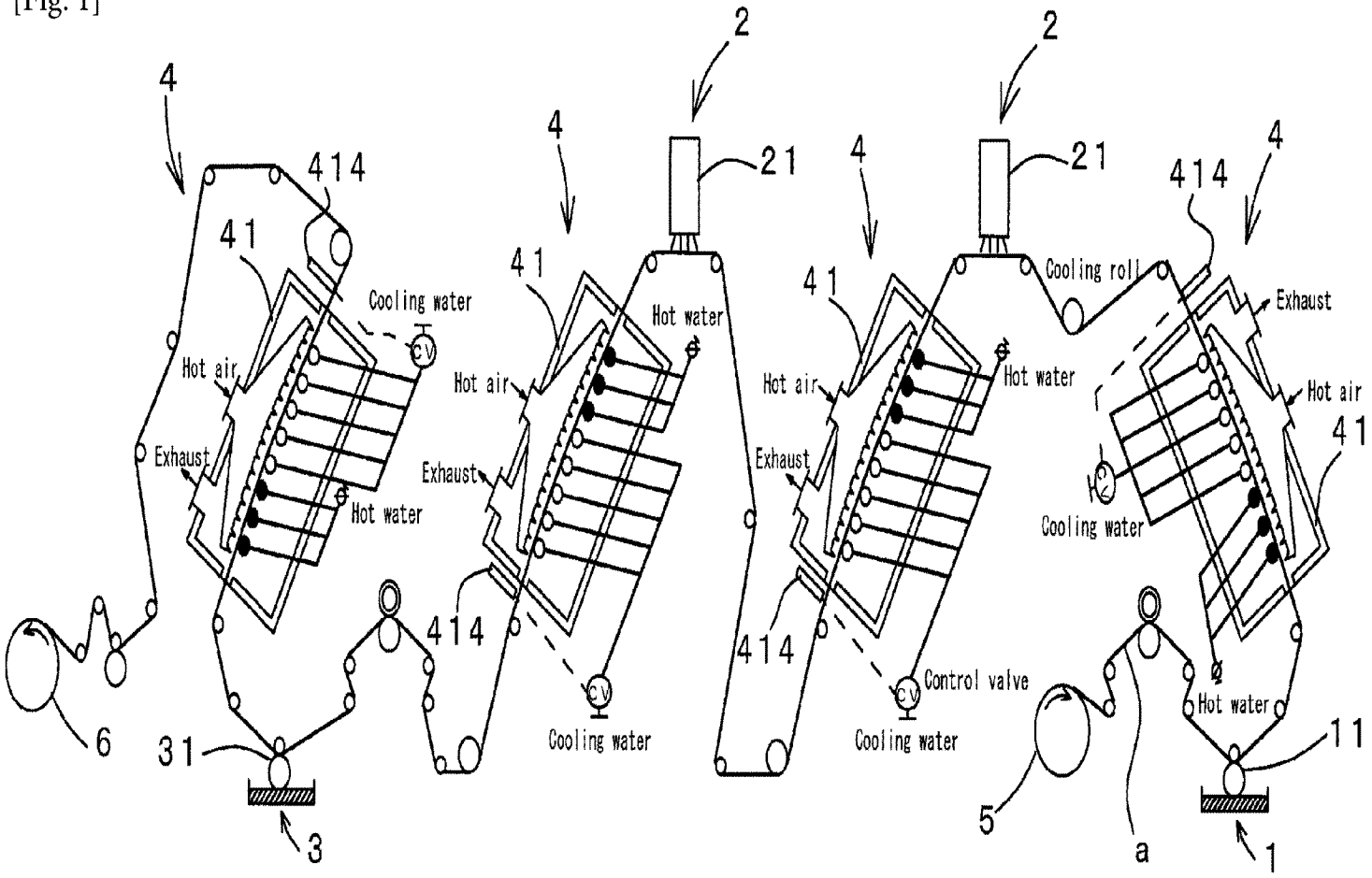

〔Fig. 2〕
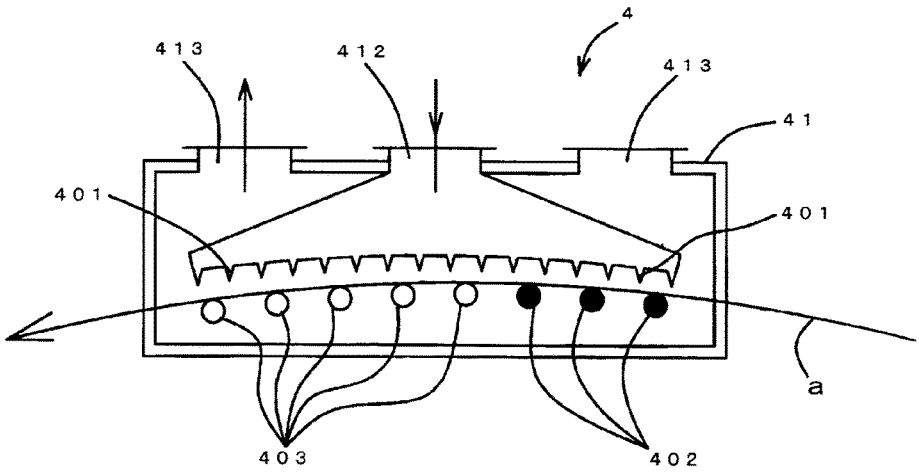
〔Fig. 3〕
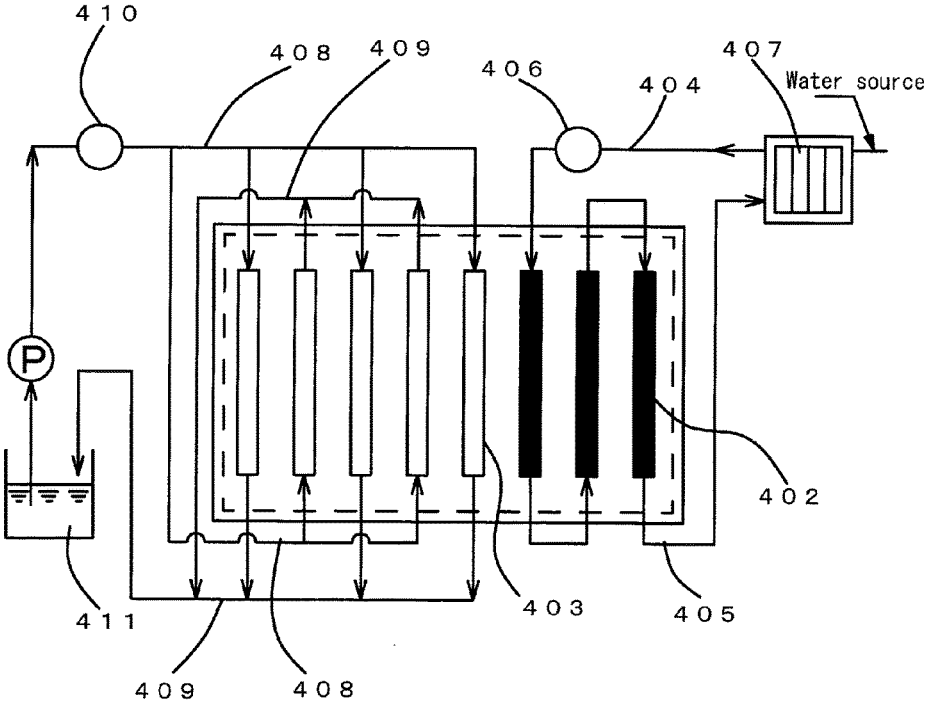

〔Fig. 4〕
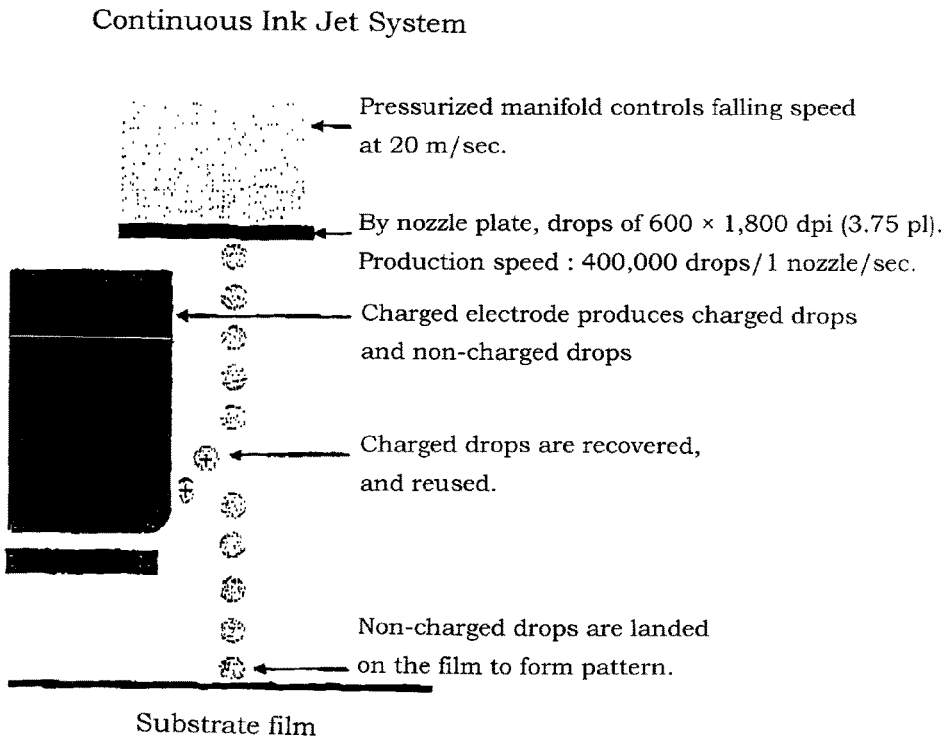

〔Fig. 5〕
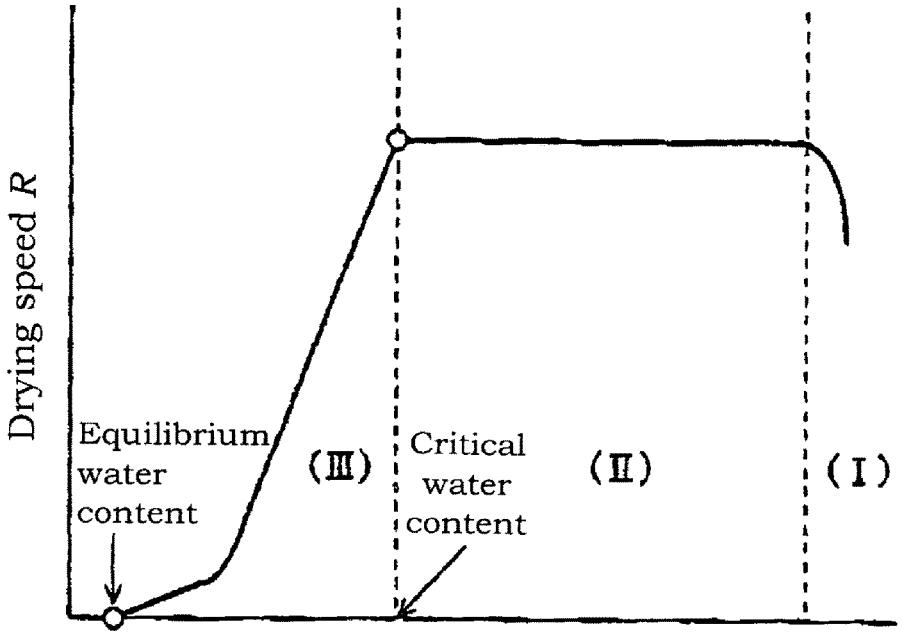
Drying characteristic curve

MULTI-COLOR PRINTING METHOD ON PLASTIC FILM AND MULTI-COLOR PRINTING APPARATUS

TECHNICAL FIELD

This invention relates to a multi-color printing method on a plastic film and an apparatus therefor, and more particularly, relates to a multi-color printing method on a plastic film, where an anchor-coating layer which acts as the receptive layer to multi-color inks and a shielding layer which is provided on the multi-color inks each by a gravure roll, and multi-color printing conducted therebetween is carried out by the ink jet printing, and an apparatus therefor.

BACKGROUND ART

In recent years, ink jet printing has progressed by the development of high-performance ink jet printers and by the improvement in inks and the like, and has been widely used in home and for commercial printing. Incidentally, in gravure printing, various works are necessary with respect to gravure rolls, such as manufacture of printing cylinder, change of the cylinder upon patterns change, cleaning, maintenance and so on. Ink jet printing is carried out with each color, i.e. by one color/head, and multi-color printing can be done easily by using plural heads. However, since printing is carried out by moving the heads along the pattern, printing speed is slow. Therefore, it is evaluated to be suitable for a small number of lots, compared with gravure printing which is applicable to a large number of lots.

Recently, the continuous ink jet system was developed and gradually utilized where very minute ink drops are produced by a spray nozzle, and fall continuously. Unnecessary ink drops are charged and recovered by an electrode, and only necessary ink drops fall and land to form patterns to achieve printing. According to this system, since the spray nozzle is not necessary to be opened and closed, there is no fear of clogging. Moreover, since the nozzle is fixed and works continuously, printing speed can be raised greatly, compared with conventional ink jet systems, and it is possible that the printing speed is made 120-180 m/min like the gravure printing. Accordingly, it can be considered that the continuous ink jet system is substituted for conventional gravure printing which was employed upon providing multi-color print on a plastic film.

In addition, inks for the ink jet are recently being changed from oily ink to aqueous ink due to the problems of bad smell, working atmosphere, residual solvent odor and reduction of $CO_2$ against global warming, etc. (For example, see Patent Documents 1-4).

PRIOR ART DOCUMENT

Patent Documents

[Patent Document 1] JP 2010-229310 A
[Patent Document 2] JP 2012-111822 A
[Patent Document 3] JP 2012-233148 A
[Patent Document 4] JP 2013-010816 A

SUMMARY OF THE INVENTION

Problems to be Solved by the Invention

As a result of the investigation by the inventors, it was found that it is difficult to conduct the multi-color printing on a plastic film only by the continuous ink jet system. Namely, it was found that the anchor-coating layer first coated onto the plastic film is desirable to be a continuous coating layer having a thickness of at least 0.1 μm in view of adhesiveness to the plastic film and receptivity to ink. However, the size of the sprayed drops in the continuous ink jet system are very small about 4 pl (picoliter), and it is difficult to form a continuous coating layer having a thickness of at least 0.1 μm. Similarly, the titanium white shielding layer coated last is desirable to render white over the entire surface by reflecting irregularly all of the light passed through the print layer, in order that the print patterns of multi-color prints are made attractive. But, it was found to be difficult to achieve this by the continuous ink jet system.

Incidentally, the printed ink is dried in a drying oven by blowing hot air to the printed surface of the plastic film, and it is necessary to supply heat for a definite time or more in order to supply necessary heat for drying. That is, for drying the ink printed on the plastic film, it is necessary to raise the temperature of the ink to a temperature capable of evaporating solvent while compensating for the latent heat of evaporation. However, even if blowing hot air, the temperature of the ink cannot become high without also raising the temperature of the plastic film. Accordingly, for elevating the temperature of the plastic film and that of the ink, a time is needed to a certain degree, because hot air is gas having a small heat capacity. Particularly, in the case of converting oily ink to aqueous ink, it becomes a great problem.

Properties of major solvents are shown in Table 1.

TABLE 1

| Solvent Name | Molecular Weight | Boiling Point (° C.) | Flashpoint (closed) (° C.) | Evaporation Latent Heat (boiling point) (KJ/kg) (cal/g) | Vapor Pressure (20° C.) (Pa) (mmHg) | Surface Tension (25° C.) (mN/m) (dyne/cm) | Solubility Parameter (Hansen) |
|---|---|---|---|---|---|---|---|
| Toluene | 92.1 | 110.6 | 4.4 | 363.6<br>86.9 | 4000<br>30.0 | 27.9 | 8.91 |
| Ethyl Acetate | 88.1 | 76.7 | −7.2 | 369<br>88.2 | 9706<br>72.8 | 23.8 | 9.10 |
| Methyl Ethyl Ketone | 72.1 | 79.6 | −4.0 | 439<br>105.2 | 9493<br>71.2 | 24.0 | 9.27 |
| Isopropanol | 60.1 | 82.3 | 11.7 | 666<br>159.2 | 4320<br>32.4 | 21.7* | 11.50 |

TABLE 1-continued

| Solvent Name | Molecular Weight | Boiling Point (° C.) | Flashpoint (closed) (° C.) | Evaporation Latent Heat (boiling point) (KJ/kg) (cal/g) | Vapor Pressure (20° C.) (Pa) (mmHg) | Surface Tension (25° C.) (mN/m) (dyne/cm) | Solubility Parameter (Hansen) |
|---|---|---|---|---|---|---|---|
| n-Propanol | 60.1 | 97.1 | 15.0 | 680<br>162.6 | 1933<br>14.5 | 23.8* | 11.97 |
| Ethanol | 46.7 | 78.3 | 16.0 | 833<br>199.2 | 7999<br>60.0 | 22.1 | 12.92 |
| Water | 18.0 | 100.0 | — | 2456<br>586.9 | 2333<br>17.5 | 71.8 | 23.50 |

*20° C.

As shown in Table 1, since evaporation latent heat of water is very great, it needs to supply a much greater quantity of heat for drying aqueous ink than the case of oily ink. Therefore, drying of aqueous ink is addressed by lengthening the drying zone or slowing down the traveling speed so as to take a longer retention time than the case of the oily ink in the drying oven.

The present invention was made in order to solve the above problems, and an object of the invention is to provide a multi-color printing method of a plastic film wherein multi-color print can be made fast without requiring complex operations, while functions of the anchor-coating layer and the shielding are ensured sufficiently.

Another object of the invention is to provide a multi-color printing method of plastic film using aqueous ink as well as oily ink, capable of printing at a traveling (producing) speed (120 m/min.~) similar to gravure printing by a short and compact drying oven.

Means for Solving the Problems

The present invention has solved the above problems by coating the anchor-coating layer, the multi-color print layer and the shielding layer by a most preferable method, wherein the first anchor-coating layer and the last shielding layer of titanium white are applied by a gravure roll, and the multi-color print layer is printed by the continuous ink jet system.

Thus, the present invention provides a method of multi-color printing on a plastic film, which comprises an anchor-coating process wherein an anchoring agent is applied to the plastic film by a gravure roll to for in an anchor-coating layer which acts as receptive layer to multi-color inks, a multi-color printing process wherein multi-color print is provided on the anchor-coating layer by continuous ink jet printers, a shielding layer-coating process wherein a titanium white ink is applied to the multi-color print by a gravure roll to form a shielding layer, and drying processes being provided after the anchor-coating process, multi-color printing process and shielding layer-coating process, respectively.

The inventors also found that the drying method previously developed by them (JP 2011-131113 A, U.S. Pat. No. 8,545,941 B2) is particularly effective for the above multi-color printing method.

Thus, in one aspect of the invention, it is provided that the above method of multi-color printing on a plastic film, wherein the drying processes are composed of conveying in a drying oven the plastic film of which the opposite side to the coating or printing side is in contact with a plurality of guide rolls of which located in the former portion are made heating guide rolls to heat the plastic film to render the temperature of the plastic film at the boiling point of water or solvent or higher immediately after entering the drying oven, and located in the latter portion are made cooling guide rolls to cool the plastic film to render the temperature of the plastic film where the plastic film is not deformed.

In another aspect of the invention, it is provided that the above method of multi-color printing on a plastic film, wherein the temperature of the plastic film before entering the drying oven and that of the plastic film immediately after discharging the drying oven are detected, and temperature of the cooling guide rolls are adjusted so that temperature of the plastic film before entering the drying oven is similar to that of the plastic film immediately after discharging the drying oven.

In still another aspect of the invention, it is provided that the above method of multi-color printing on a plastic film, wherein the heating guide rolls are heated by charging hot water or heated oil, and the cooling guide rolls are cooled by charging cooled water.

In yet another aspect of the invention, it is provided that the above method of multi-color printing on a plastic film, wherein the heating guide rolls and cooling guide rolls are forced to drive to synchronize them with travelling speed of the plastic film.

In a further aspect of the invention, it is provided that a multi-color printing apparatus for a plastic film comprising an anchor-coating section where an anchoring agent is applied to a plastic film by a gravure roll to form an anchor-coating layer which acts as receptive layer to multi-color inks, a multi-color printing section where multi-color print is provided on the anchor-coating layer by continuous ink jet printers, a shielding layer-coating section where a titanium white ink is applied to the multi-color print by a gravure roll, and drying sections being provided after the anchor-coating section, multi-color printing section, and shielding layer-coating section, respectively.

Effects of the Invention

In the multi-color printing method of a plastic film of the invention, the multi-color printing is carried out by the continuous ink jet printer. Therefore, printing can be conducted at a speed equivalent to conventional gravure printing, and nevertheless, works accompanied with the gravure roll in the gravure printing are not needed, such as manufacture of printing cylinder, change of the cylinder upon patterns change, cleaning, maintenance and so on.

Besides, since the anchor-coating layer and the shielding layer are applied by a gravure roll, these layers can be coated easily with a prescribed thickness or more to exhibit their functions sufficiently.

Even when patterns of the multi-color print are changed, the anchor-coating layer and the shielding layer are not necessary to be changed. Therefore, works of changing printing cylinder and the like are not needed, because these layers are applicable irrespective of patterns of the multi-color print.

As mentioned above, in the present invention, the merits of both the continuous ink jet printing and the gravure printing are exhibited, and the demerits are removed, by combining them.

In one aspect of the invention, the guide rolls located in the former portion of the drying oven are made heating guide rolls to heat the plastic film to render the temperature the boiling point of water or solvent or higher immediately after entering the drying oven, and located in the latter portion are made cooling guide rolls to cool the plastic film to a temperature where the plastic film is not deformed. Accordingly, since the temperature of the plastic film can be made at the boiling point of water or solvent or higher immediately after entering the drying oven, the plastic film can be dried efficiently. Since overheating of the plastic film can be avoided effectively by the cooling, the deformation of the plastic film can be prevented.

Namely, the guide rolls provided in the former portion are heated, and the plastic film introduced into the drying oven is heated by the heating guide rolls from the opposite side to the water or solvent-applied side in addition to blowing hot air. Thereby, the temperature of the plastic film can be raised up to the boiling point or higher of water or solvent in a short period.

In addition, once the temperature of the plastic film is elevated by the heating guide rolls, the temperature of the plastic film is further raised by blowing hot air for drying to generate deformation, such as elongation, contraction, and waviness. Therefore, in order to avoid the deformation, the latter portion of guide rolls are cooled, and further temperature elevation of the plastic film is inhibited by the cooling rolls.

In the another aspect of the invention, the temperature of the plastic film before entering the drying oven and that of the plastic film immediately after discharging the drying oven are detected, and the temperature of the cooling guide rolls are adjusted so that the temperature of the plastic film before entering the drying oven is similar to that of the plastic film immediately after discharging the drying oven. Therefore, discrepancy among prints of each color in multi-color print layer can be avoided.

In still another aspect of the invention, the heating guide rolls are heated by charging hot water or heating oil, and the cooling guide rolls are cooled by charging cooling water. Therefore, the heating guide rolls can be heated cheaply, easily and surely, and the cooling rolls can be cooled cheaply, easily and surely.

In yet another aspect of the invention, since the heating guide rolls and cooling guide rolls are forced to drive to synchronize them with travelling speed of the plastic film, the generation of the deformation, such as elongation, contraction and waviness can be prevented in the plastic film.

In a further aspect of the invention, the multi-color printing apparatus for a plastic film comprises an anchor-coating section where an anchoring agent is applied to a plastic film by a gravure roll to form an anchor-coating layer which acts as receptive layer to multi-color inks, a multi-color printing section where multi-color print is provided on the anchor-coating layer by continuous ink jet printers, a shielding layer-coating section where a titanium white ink is applied to the multi-color print by a gravure roll, and drying sections being provided after the anchor-coating section, multi-color printing section, and shielding layer-coating section, respectively. Therefore, the apparatus can be the aforementioned multi-color printing method of a plastic film of the invention can be performed surely, and similar functions and effects can be exhibited.

BRIEF DESCRIPTION OF THE DRAWINGS

FIG. 1 Schematic general view of a printing apparatus which carries out the printing method of a plastic film according to the invention.

FIG. 2 Schematic view of the drying section of the printing apparatus which carries out the printing method of a plastic film according to the invention.

FIG. 3 Figure illustrating the pipe line at the drying section of the printing apparatus which carries out the printing method of a plastic film according to the invention.

FIG. 4 Explanatory drawing of the continuous ink jet system.

FIG. 5 Figure indicating a drying characteristic in curve.

MODE FOR CARRYING OUT THE INVENTION

The multi-color printing method of a plastic film according to the invention has an anchor-coating process wherein an anchor-coating layer which acts as the receptive layer to multi-color inks, is applied to the plastic film by a gravure roll, a multi-color printing process wherein multi-color print is provided on the anchor-coating layer by continuous ink jet printers, and a shielding layer-coating process wherein the shielding layer is applied to the multi-color print by a gravure roll.

In the invention, multi-color print is conducted by continuous ink jet printers, and as shown in FIG. 4, in the continuous ink jet printer, very minute ink drops are produced by a spray nozzle and fall continuously. Unnecessary ink drops are charged and recovered by an electrode, and only necessary ink drops fall and land to form patterns to achieve printing. The printer can print at a printing speed equivalent to conventional gravure printing, and dissolves defects of the gravure printing.

The continuous ink jet printers are sold, for example, by Eastman Kodak Company Ltd. under the tradename "Kodak ULTRASTREAM", which is possible to print on paper by oily ink at a speed of 300 m/min.

Coating of the anchor-coating layer is carried out by using a gravure roll. The anchor-coating layer is required to have adhesiveness to the plastic film and receptivity to ink, and in order to ensure them, the anchor-coating layer is necessary to be a continuous coating layer having a thickness of at least 0.1 μm, preferably 0.2 μm or more. These can be secured easily and surely by using a gravure roll.

Suitable gravure rolls therefor are designed so that the thickness of the anchor-coating layer becomes 0.1 μm or more. For example, the thickness can be made 0.1 μm or more by using a gravure roll having a screen ruling of 150 lines and the printing depth of 51 μm.

Coating of the shielding layer is carried out by using a gravure roll. The shielding layer is required to reflect irregularly all of the light passed through the multi-color print layer, it is necessary that the thickness of the coating layer is made 0.1 μm or more, preferably 0.2 μm or more. This can be secured easily and surely by using a gravure roll.

Suitable gravure rolls therefor are designed so that the thickness of the shielding layer becomes 0.1 μm or more. For example, when a gravure roll having a screen ruling of 150 lines and the printing depth of 51 μm is used, in the case that the shielding layer is made of titanium white, the transferring quantity of titanium white ink is 9.0 g/m$^2$, and as can be seen from the Examples, when pigment concentration of the titanium white ink is 30% by weight, the thickness becomes 0.7 μm.

After each of the aforementioned anchor-coating process, multi-color printing process and shielding layer-coating process, a drying process is provided. The drying process is to convey in a drying oven a plastic film of which the opposite side to the coated or printed side is in contact with a plurality of guide rolls, and among the guide rolls, those in the former portion are made heating guide rolls and the latter portion are made cooling guide rolls. The plastic film immediately after entering the drying oven is heated by the heating guide rolls up to the boiling point of water or solvent or higher, and thereafter, the plastic film is cooled by the cooling guide rolls to maintain a temperature where the film is not deformed.

In the drying process, the plastic film on which a liquid agent (anchor coating liquid, ink, shielding liquid) is coated is introduced into the drying oven, and water or solvent in the liquid agent is evaporated to fix the components dissolved therein to the plastic film. The drying speed controls the printing speed.

Generally, as shown by the drying characteristic curve in FIG. 5, drying is carried out through a material preheating period (I), a constant rate drying period (II) and a falling rate drying period (III). The material preheating period is the section where the temperature of material is raised up to the wet-bulb temperature, and variation of moisture is small in this section. The constant rate drying period is in a dynamic equilibrium where the heat transfer speed from the circumference is balanced with the evaporation speed from the material surface, and the drying speed R is constant in this section. The falling rate drying period is a section of the critical moisture content at the finish point of the constant rate drying period or less, and resistance to moisture migration in the material increases with decreasing moisture content, and drying speed falls thereby.

The coating liquid agent is liquid. The boiling point of the solvent component corresponds to the constant rate drying temperature. In order to render the coating liquid agent at the temperature of boiling point, it is necessary to render the temperature of the plastic film to which the coating liquid agent has been applied, at the temperature of boiling point. Heretofore, heating was carried out by blowing hot air as the sole heat source toward the liquid agent coating side. However, since heat capacity of hot air is small due to being gas, time is required for elevating the temperature of the plastic film. However, when the former portion of guide rolls which convey the plastic film is made heating guide rolls to heat the side of the plastic film to be in contact therewith, since the heat capacity of solid is greater than that of gas, heating can be carried out quickly.

In the constant rate drying temperature (boiling point), heat is taken away by the evaporation latent heat shown in the aforementioned Table 1 by the evaporation of liquid, and thereby, the temperature of the plastic film and also that of the coated liquid agent do not exceed those temperatures. However, when the constant rate drying state is passed, absorption of heat by evaporation latent heat does not occur. Therefore, the temperature of the plastic film rises by the heat of hot air to induce elongation, contraction, deformation or the like. In order to prevent this, the latter portion of guide rolls is made cooling guide rolls to dissolve the heat supplied by hot air by the cooling guide rolls. That is, until finishing the constant rate drying period passing through the material preheating period, the plastic film is heated by the heating guide rolls within the range of not higher than the boiling point where deformation and the like do not occur, and from the start of the falling rate drying period after finishing the constant rate drying period, the temperature is maintained in the range of not generating deformation or the like by inhibiting temperature elevation caused by hot air.

The constitution ratio of the heating guide rolls to the cooling guide rolls in the total guide rolls in the drying oven varies depending on the type (aqueous, oily) of the coating liquid agent, thickness of the plastic film, processing speed, and it is preferred to be set by conducting tests under these respective conditions. In brief, the ratio of the heating guide rolls is set around 1/5-1/3 of the number of the total guide rolls, and preferable conditions can be sought by controlling the temperature of the guide rolls.

The heating guide rolls are heated by injecting hot water or heating oil into the guide rolls, and are set at a desired temperature by adjusting the temperature, flow rate or the like. The temperature of the heating guide rolls varies depending on the type (aqueous, oily) of the coating liquid agent, thickness of the plastic film, and processing speed, and it is preferred to be set by conducting tests under these respective conditions.

The injection of hot water or heating oil can be conducted, for example, by connecting liquid delivery pipes so as to circulate hot water or heating oil through the guide rolls, and providing a heating portion for heating the hot water or heating oil and a liquid delivery portion capable of adjusting flow rate in the course of the liquid delivery pipes. Alternatively, hot water or heating oil may be injected from their supply sources by connecting liquid delivery pipes through a pump. The heating guide rolls may be connected as a whole or individually. Furthermore, when the heating guide rolls are connected individually with stop valves, heating conditions can be set in delicate by the on-off of them.

The cooling guide rolls are cooled by injecting cooling water into the guide rolls, and as a result, the plastic film in contact with the cooling guide rolls is cooled. The injection of cooling water can be conducted, for example, by connecting liquid delivery pipes so as to circulate cooling water through the guide rolls and providing a cooling portion for cooling water and a liquid delivery portion capable of adjusting flow rate in the course of the liquid delivery pipes. Alternatively, cooling water may be injected from their supply sources by connecting liquid delivery pipes through a pump. The cooling guide rolls may be connected as a whole or individually.

It is preferred to force to drive the heating guide rolls and the cooling guide rolls to synchronize them with a conveying speed of the plastic film. The means for forcing to drive the guide rolls is, for example, driving the guide rolls by a belt to conform to the conveying speed of the plastic film. In this case, a pulley having the same diameter as the diameter at the face coming in contact with the plastic film of the guide roll is mounted at an end of each guide roll, and a belt is wound on the pulleys in common. Thereby, they can be easily matched with the conveying speed of the plastic film.

The flow rate of cooling water being injected into the guide roll can be adjusted by the detected temperature of the plastic film before drying so that the temperature of the plastic film after drying is almost the same as that before drying. The temperature of the plastic film can be detected by using a known temperature sensor or the like. The adjustment of the flow rate of cooling water by the detected temperature is carried out as follows: That is, by providing a controller wherein a relationship between temperature and flow rate has been input, and by transmitting the detected temperature to the controller, the controller controls a pump of cooling water or the like to adjust so as to render the prescribed flow rate of the cooling water.

Plastic films applicable to the multi-color printing method of the plastic film of the invention include but are not limited to films of polyethylene terephthalate (PET), oriented polyamide (O-NY), oriented polypropylene (OPP), polyethylene (PE), polypropylene (PP), polystyrene (PS) and so on.

An embodiment of the method of multi-color printing on a plastic film of the invention is explained with reference to drawings.

FIG. 1 is a schematic general view of a printing apparatus which carries out the multi-color printing method of a plastic film, FIG. 2 is a schematic view of the drying section for the drying process, and FIG. 3 is a figure illustrating the constitution of the heating guide rolls and the cooling guide rolls in the drying section.

In FIG. 1, 1 is the anchor-coating section, 2 is the multi-color printing section, 3 is the shielding layer (titanium white)-coating section, 4 is the drying section, 5 is a delivery roll which deliveries the plastic film a, and 6 is a winding roll which winds the plastic film a to which the multi-color print has been provided.

In the anchor-coating section, 11 is the gravure roll which coats the anchor-coating layer. By the gravure roll 11, the anchor-coating layer is coated in the manner similar to conventional gravure printing.

In the multi-color printing section, 21 is the continuous ink jet printer. In the continuous ink jet printer 21, as shown in FIG. 4, the nozzle is continuously released without on-off, and ink drops flow down continuously. Unnecessary ink drops are charged and recovered, and the ink drops necessary for patterns fall as is and land on the plastic film to form the patterns. The number of the ink drops is 600×1,800 dpi, i.e. there are 600×1,800 drops between 1 inch (2.54 cm), and the size of one drop is very small 3.75 pl (picoliter). Therefore, a precise image can be formed.

In addition, although two continuous ink jet printers 21 are set in this embodiment, the printers 21 are set as many as the number of necessary colors. For example, in the case of multi-color printing composed of yellow, red, blue and black, 4 printers are set.

In the shielding layer-coating section, 31 is the gravure roll which coats the shielding layer. By the gravure roll 31, the shielding layer is coated in the manner similar to conventional gravure printing.

In the drying section 4, in the drying oven 41, a plurality of hot air blow-off nozzles 401 are provided at regular intervals, and heating guide rolls 402 are provided in the former portion and cooling guide rolls 403 are provided in the latter portion, so that they meet these hot air blow-off nozzles 401. To the heating guide roll 402, liquid delivery pipes 404 for injecting hot water and a discharge pipe for discharging the hot water are connected. To the liquid delivery pipe 404, a control valve 406 for adjusting the flow rate of hot water and a heating unit 407 for heating water are also connected. The discharge pipe 405 is connected to the heating unit 407 on the opposite side. As a result, hot water circulates through the heating unit 407, the control valve 406 and the heating guide roll 402.

To the cooling guide roll 403, liquid delivery pipes 408 for injecting cooling water and a discharge pipe 409 for discharging the cooling water are connected. To the liquid delivery pipe 408, a control valve 410 for adjusting the flow rate of cooling water and a cooling unit 411 for cooling water are also connected. The discharge pipe 409 is connected to the cooling unit 411 on the opposite side. As a result, cooling water circulates through the cooling unit 411, the control valve 410 and the cooling guide roll 403. 412 is an inlet port of hot air, and 413 is an exhaust port of hot air.

At the exit of the drying section 4, a surface thermometer 414 is attached which measures the surface temperature of the plastic film a passed through the cooling guide rolls 403. The surface thermometer 414 is connected to a controller (not illustrated), and the controller commands to inject cooling water into the cooling guide rolls 403 with an injection volume which has previously been set, by the temperature signal from the surface thermometer 414.

EXAMPLES

Example 1

Anchor-Coating Process

Using a gravure roll of which the plate cylinder was an oblique line plate having a screen ruling of 200 lines, a printing depth of 20 μm, a one-pack type aqueous anchor coating agent "180E" manufactured by Nippon Soda Co., Ltd. was applied to the whole corona-treated surface of the PET film manufactured by Toyobo Co., Ltd. (thickness: 12 μm, width: 1000 mm, one surface was corona-treated) at an application speed of 120 m/min by the reverse system.

Drying Process

The guide rolls were composed of 3 heating guide rolls and 4 cooling guide rolls, and hot water at 90° C. was supplied to the heating guide rolls, and cooling water at 20° C. was supplied to the cooling guide rolls. Hot air was blown to the applied surface at 150° C. at 70 $m^3$/min. The processing speed was 120 m/min which was the same as the anchor-coating speed.

Multi-Color Printing Process

Using the ink jet printers "Kodak ULTRASTREAM" manufactured by Eastman Kodak Company Ltd., multiple printing with square-lattice shaped patterns was conducted in the order of first color yellow, second color red, third color blue and fourth color black, by each aqueous ink.

Drying Process

The guide rolls were composed of 3 heating guide rolls and 4 cooling guide rolls, and hot water at 90° C. was supplied to the heating guide rolls, and cooling water at 20° C. was supplied to the cooling guide rolls. Hot air was blown to the printed surface at 150° C. at 70 $m^3$/min. The processing speed was 120 m/min which was the same as the anchor-coating speed. The drying process was conducted after each color printing step of the multi-color printing process, i.e. four times.

Shielding Layer Coating Process

Using a gravure roll of which the plate cylinder was carved by the electroengraving of helio gravure with a screen ruling of 150 lines, a printing depth of 51 μm, a transferring quantity of ink of 9.0 g/$m^2$ (wet), a white ink (titanium white pigment concentration: 30% by weight) which was prepared using 100 parts by volume of water-soluble ink "HYDRIC PRP-401" manufactured by Dainichi Seika Color & Chemicals Manufacturing Co., Ltd. by adding 40 parts by volume of a diluent solvent "HYDRIC 5032" (50 parts by volume of methanol, 30 parts by volume of isopropanol, 20 parts by volume of water), was applied to the whole surface provided with multi-color print.

Drying Process

The guide rolls were composed of 3 heating guide rolls and 4 cooling guide rolls, and hot water at 90° C. was supplied to the heating guide rolls, and cooling water at 20° C. was supplied to the cooling guide rolls. Hot air was blown to the applied surface at 150° C. at 70 $m^3$/min. The processing speed was 120 m/min which was the same as the anchor-coating speed.

Temperature of Plastic Film after Passing Through Drying Process

The temperature of the plastic film passed each drying process of the anchor-coating process, multi-color printing process and the shielding layer-coating process (titanium white-coating process) was measured by using a radiation thermometer, and it was examined whether each temperature was almost the same or not. The measured results are shown in Table 2.

TABLE 2

| Measured Position | | Room Temp 25° C. Temprature |
|---|---|---|
| Anchor-Corating Process | | 26° C. |
| Multi-Color Printing Process | Yellow | 27° C. |
| | Red | 27° C. |
| | Blue | 27° C. |
| | Black | 27° C. |
| Shielding Layer-Coating Process | | 28° C. |

The temperature of the plastic film after passing each drying process (exit of the drying section) was almost the same, and it was confirmed that the heat added by the heating guide rolls and hot air was suitably removed by the cooling guide rolls.

<Observation of Printed Matter by Naked Eye>

In the multiple print of the square-lattice shaped pattern printed in the order of yellow-red-blue-black, the print in length of 2,000 m was observed by naked eye, and it was found that the square-lattice shaped yellow pattern, which had printed at first, was printed clearly over the entire surface on the white color from the first to the last, and the squeeze-out of color caused by print slippage did not occur.

Example 2

All of the anchor-coating process, the multi-color printing process and the shielding layer-coating process were carried out similar to Example 1. That is, the same anchor-coating layer as Example 1 was applied to the corona-treated surface of the PET film manufactured by Toyobo Co., Ltd. (thickness: 12 μm, width: 1000 mm, one surface was corona-treated), and the multi-color printing of yellow, red, blue and black was conducted on the anchor-coating layer. The same titanium white (shielding layer) as Example 1 was applied over the whole surface of the multi-color print layer. The application and printing speed was the same 120 m/min as Example 1, and the other conditions were also entirely similar to Example 1.

The multi-color print was made a landscape picture of so-called Mount Fuji looked from the pine grove of Miho, composed of a big branch of pine tree on the left side of the close-range view, a pine forest on the left half of the middle-range view and sea with white waves rolling therein on the right half of the middle-range view, and the Mt. Fuji with snow at the top in a distant view.

<Resistance to Abrasion>

The surface of the print was scratched by a nail, and the appearance was observed. As a result, no damage nor peeling occurred on the surface. Therefore, it was confirmed that the anchor-coating layer tightly adhered to the plastic film, and received ink sufficiently.

<Observation of Appearance of Print>

The print excellently reproduced respective parts having their original color that the branch of pine and pine forest were made green of original pine, the white wave was made white, the sea was made blue and the snow of Mt. Fuji was made white. Therefore, it was confirmed that the titanium white (shielding layer) provided over the entire surface of the print was formed with a sufficient thickness and sufficient shielding ability was ensured without seeing the plastic film.

The titanium white was applied over the entire surface with the titanium white concentration of 30% by weight by the gravure roll having a screen ruling of 150 lines, a plate depth of 51/i m, and a transferring quantity of ink of 9.0 g/$m^2$ (wet), and the thickness of the titanium white was as follows:

Weight after drying: 9.0 g/$m^2$×30/100=2.7 g/$m^2$

Conversion to volume: estimating specific gravity being about 4.0, 2.7/4≈0.7 ml/$m^2$ Conversion to thickness: 0.7 ml/10,000=0.7 μm

DESCRIPTION OF REFERENCE SIGNS

1 Anchor-coating section
  11 Gravure roll
2 Multi-color printing section
  21 Continuous ink jet printer
3 Shielding layer-coating section
  31 Gravure roll
4 Drying section
  41 Drying oven
    402 Heating guide roll
    403 Cooling guide roll

The invention claimed is:

1. A method of multi-color printing on a plastic film, consisting essentially of:

an anchor-coating process wherein an anchoring agent is applied to the plastic film by a gravure roll to form an anchor-coating layer which consists essentially of the anchoring agent and acts as receptive layer to multi-color inks, a multi-color printing process wherein multi-color print is applied on said anchor-coating layer by continuous ink jet printers, a shielding layer-coating process wherein a titanium white ink is applied to said multi-color print by a gravure roll to form a shielding layer, and drying processes being provided after said anchor-coating process, multi-color printing process and shielding layer-coating process, respectively, wherein said continuous ink jet printers are separated for each color ink, and printing of each color is carried out separately, followed by one of said drying processes.

2. The method of multi-color printing on a plastic film as set forth in claim 1, wherein said drying processes are composed of conveying the plastic film in a drying oven, wherein the side of the plastic film opposite to the side subjected to coating or printing is in contact with a plurality of guide rolls of which located in the former portion are made heating guide rolls to heat the plastic film to render the temperature of the plastic film at the boiling point of water or solvent or higher immediately after entering the drying oven, and located in the latter portion are made cooling guide rolls to cool the plastic film to render the temperature of the plastic film where the plastic film is not deformed.

3. The method of multi-color printing on a plastic film as set forth in claim 2, wherein the temperature of the plastic film before entering the drying oven and the temperature of the plastic film immediately after discharging the drying oven are detected, and the temperature of the cooling guide rolls are adjusted so that the temperature of the plastic film before entering the drying oven is similar to the temperature of the plastic film immediately after discharging the drying oven.

4. The method of multi-color printing on a plastic film as set forth in claim 2, wherein said heating guide rolls are heated by charging hot water or heating oil, and said cooling guide rolls are cooled by charging cooling water.

5. The method of multi-color printing on a plastic film as set forth in claim 2, wherein said heating guide rolls and cooling guide rolls are forced to drive to synchronize them with a travelling speed of the plastic film.

6. The method of multi-color printing on a plastic film as set forth in claim 1, wherein said anchoring agent is a modified poly(1,2-butadiene).

7. A multi-color printing apparatus for a plastic film consisting essentially of:

an anchor-coating section where an anchoring agent is applied to a plastic film by a gravure roll to form an anchor-coating layer which consists essentially of the anchoring agent and acts as receptive layer to multi-color inks, a multi-color printing section where multi-color print is applied on said anchor-coating layer by continuous ink jet printers, a shielding layer-coating section where a titanium white ink is applied to said multi-color print by a gravure roll, and drying sections being provided after said anchor-coating section, multi-color printing section, and shielding layer-coating section, respectively, wherein said continuous ink jet printers are separated for each color ink, and provided with one of said drying sections.

8. The multi-color printing apparatus for a plastic film as set forth in claim 7, wherein said anchoring agent is a modified poly(1,2-butadiene).

* * * * *